US010619829B2

(12) United States Patent
Dubuc et al.

(10) Patent No.: US 10,619,829 B2
(45) Date of Patent: Apr. 14, 2020

(54) REPLACEABLE LED LIGHT SOURCE FOR AN LED TRAFFIC SIGNAL APPLICATION

(71) Applicant: CURRENT LIGHTING SOLUTIONS, LLC, East Cleveland, OH (US)

(72) Inventors: Eden Dubuc, Lachine (CA); Yu Felix Fan, Lachine (CA); Luigi Tavernese, Lachine (CA)

(73) Assignee: CURRENT LIGHTING SOUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/644,887

(22) Filed: Jul. 10, 2017

(65) Prior Publication Data

US 2019/0011114 A1 Jan. 10, 2019

(51) Int. Cl.

| | |
|---|---|
| ***F21V 17/00*** | (2006.01) |
| ***F21V 5/04*** | (2006.01) |
| ***F21V 29/85*** | (2015.01) |
| ***F21V 19/00*** | (2006.01) |
| ***G08G 1/095*** | (2006.01) |
| ***F21V 7/00*** | (2006.01) |
| ***F21V 19/04*** | (2006.01) |

(Continued)

(52) U.S. Cl.

CPC ..... *F21V 17/002* (2013.01); *F21K 9/00* (2013.01); *F21V 5/005* (2013.01); *F21V 5/008* (2013.01); *F21V 5/04* (2013.01); *F21V 7/0041* (2013.01); *F21V 7/0091* (2013.01); *F21V 19/0015* (2013.01); *F21V 19/04* (2013.01); *F21V 29/503* (2015.01); *F21V 29/85* (2015.01); *G08G 1/095* (2013.01); *F21W 2111/02* (2013.01); *F21Y 2115/10* (2016.08)

(58) Field of Classification Search

CPC ..... F21V 17/002; F21V 29/85; F21V 5/04; F21V 19/0015; G08G 1/095; F21Y 2115/10; F21W 2111/02

USPC ..... 340/907

See application file for complete search history.

(56) References Cited

U.S. PATENT DOCUMENTS

| | | | |
|---|---|---|---|
| 6,796,698 | B2 | 9/2004 | Sommers et al. |
| 6,911,915 | B2 | 6/2005 | Wu et al. |

(Continued)

FOREIGN PATENT DOCUMENTS

| | | | |
|---|---|---|---|
| AU | 2009222549 | A1 | 10/2009 |
| GB | 2486236 | A | 6/2012 |

OTHER PUBLICATIONS

Extended European Search Report and Opinion issued in connection with corresponding EP Application No. 18182403.8 dated Feb. 5, 2019.

*Primary Examiner* — Jack K Wang

(74) *Attorney, Agent, or Firm* — Buckley, Maschoff & Talwalkar LLC

(57) ABSTRACT

Provided is a lighting device that includes a housing having an open end and a closed end, a signal replaceable light source that includes a light source connected disposed near the closed end and configured to generate light, an inner refractive optical element encapsulating the light source configured to reflect the light towards the open end, and an electronic component configured to control operation of the light source; and outer refractive optical element disposed at the open end and configured to receive the light from the inner refractive optical element and reflect the light therefrom.

20 Claims, 4 Drawing Sheets

(51) Int. Cl.

| | |
|---|---|
| ***F21K 9/00*** | (2016.01) |
| ***F21V 5/00*** | (2018.01) |
| ***F21V 29/503*** | (2015.01) |
| *F21W 111/02* | (2006.01) |
| *F21Y 115/10* | (2016.01) |

(56) References Cited

U.S. PATENT DOCUMENTS

| | | | | |
|---|---|---|---|---|
| 7,434,968 | B2 | 10/2008 | Wu | |
| 7,465,075 | B2 * | 12/2008 | Chinniah | F21S 48/215 362/334 |
| 7,810,963 | B2 * | 10/2010 | Peck | F21V 5/008 362/249.02 |
| 7,868,903 | B2 | 1/2011 | Wendler et al. | |
| 8,567,991 | B2 * | 10/2013 | Krogman | F21S 8/022 362/249.02 |
| 8,668,351 | B2 * | 3/2014 | Dubuc | F21V 5/045 362/235 |
| 8,833,978 | B2 * | 9/2014 | Wu | F21V 5/045 359/742 |
| 2003/0185005 | A1 * | 10/2003 | Sommers | F21V 7/041 362/240 |
| 2004/0004836 | A1 | 1/2004 | Dubuc | |
| 2004/0042208 | A1 * | 3/2004 | Wu | F21V 5/045 362/245 |
| 2004/0252520 | A1 * | 12/2004 | Martineau | F21V 5/045 362/545 |
| 2008/0218993 | A1 | 9/2008 | Li | |
| 2011/0182069 | A1 | 7/2011 | Dubuc | |
| 2013/0155670 | A1 | 6/2013 | Handsaker | |
| 2015/0300574 | A1 | 10/2015 | Preuschl et al. | |
| 2017/0108178 | A1 * | 4/2017 | Dubuc | F21V 7/0008 |

* cited by examiner

REPLACEABLE LED LIGHT SOURCE FOR AN LED TRAFFIC SIGNAL APPLICATION

I. TECHNICAL FIELD

The present invention relates generally to an LED (light emitting diode) traffic signal application. In particular, the present invention relates to a replaceable LED light source for an LED traffic signal application, having heat dissipation capabilities.

II. BACKGROUND

An LED traffic signal is typically implemented at traffic intersections to control the flow of traffic. The LED traffic signals typically include a light source, a housing and at least one lens to reflect light transmitted from the light source in a direction visible for the drivers.

As shown in FIG. 1, the LED traffic signal 50 is formed of a single unit that includes a housing 1 having an open-end 2 that is covered by an outer lens or spreading window 3, a plurality of LEDs 4 located near a center axis 6 of the housing 1 and an inner lens 7 (e.g., a Fresnel lens) between the outer lens or spreading window 3 and the LEDs 4. The LEDs 4 are in a fixed position on the printed circuit board 5 within the housing 1. Therefore, when the LEDs 4 malfunction and need to be replaced, the entire LED traffic signal 50 typically needs to be replaced. It is desirable to have a replaceable light source for an LED traffic signal which can be easily replaced or repaired, thereby minimizing maintenance costs and time.

III. SUMMARY OF THE EMBODIMENTS

Given the aforementioned deficiencies, a need exists for a replaceable light source without having to replace an outer lens of the LED traffic signal.

Under certain circumstances, embodiments of the present invention provides a lighting device that includes a housing having an open end and a closed end, a signal replaceable light source that includes a light source connected disposed near the closed end and configured to generate light, an inner refractive optical element encapsulating the light source configured to reflect the light towards the open end, and an electronic component configured to control operation of the light source: and outer refractive optical element disposed at the open end and configured to receive the light from the inner refractive optical element and reflect the light therefrom.

An embodiment of the present invention includes a lighting device that includes a housing having an open end and a closed end, a lighting component as a single unit, that includes a light source disposed along an optical axis and connected to the closed end and configured to generate light, an electronic component configured to control operation of the light source, and an inner refractive optical element configured to reflect the light, and an outer refractive optical element configured to receive the light from the inner refractive optical element and reflect the light therefrom.

According to yet another embodiment, a method for operating the lighting device is provided.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

IV. DESCRIPTION OF THE DRAWINGS

Figure 1:
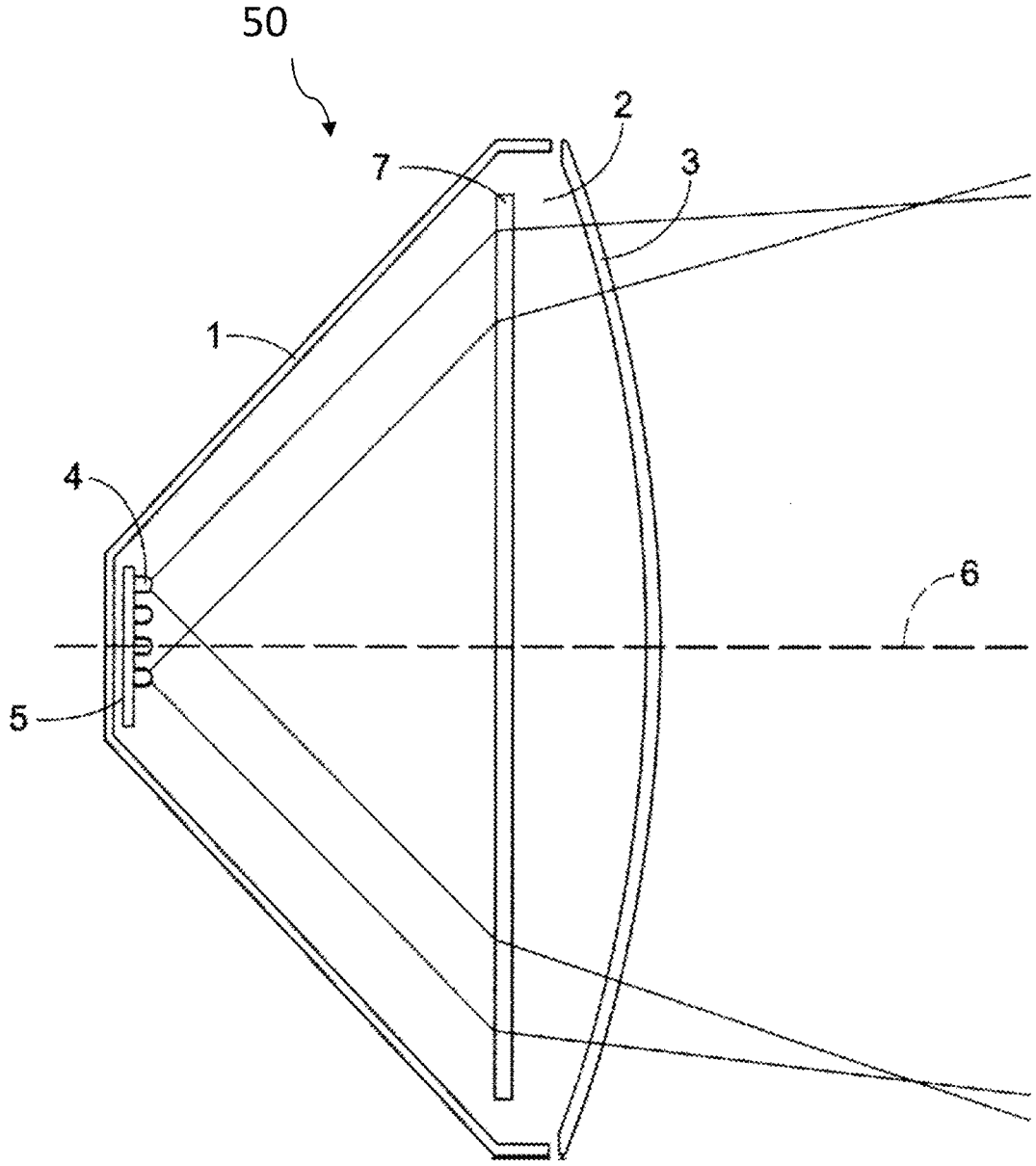
FIG. 1 PRIOR ART
FIG. 1 is a schematic illustrating a conventional LED traffic signal.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

V. DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components.

In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

As noted above, the embodiments provide a replaceable light source that can be implemented within an LED traffic signal application. The replaceable light source is not limited to being implemented within an LED traffic signal application and can be implemented within any type of suitable lighting application. The replaceable light source can be easily replaced or repaired without having to replace the front or outer lens.

Figure 2:
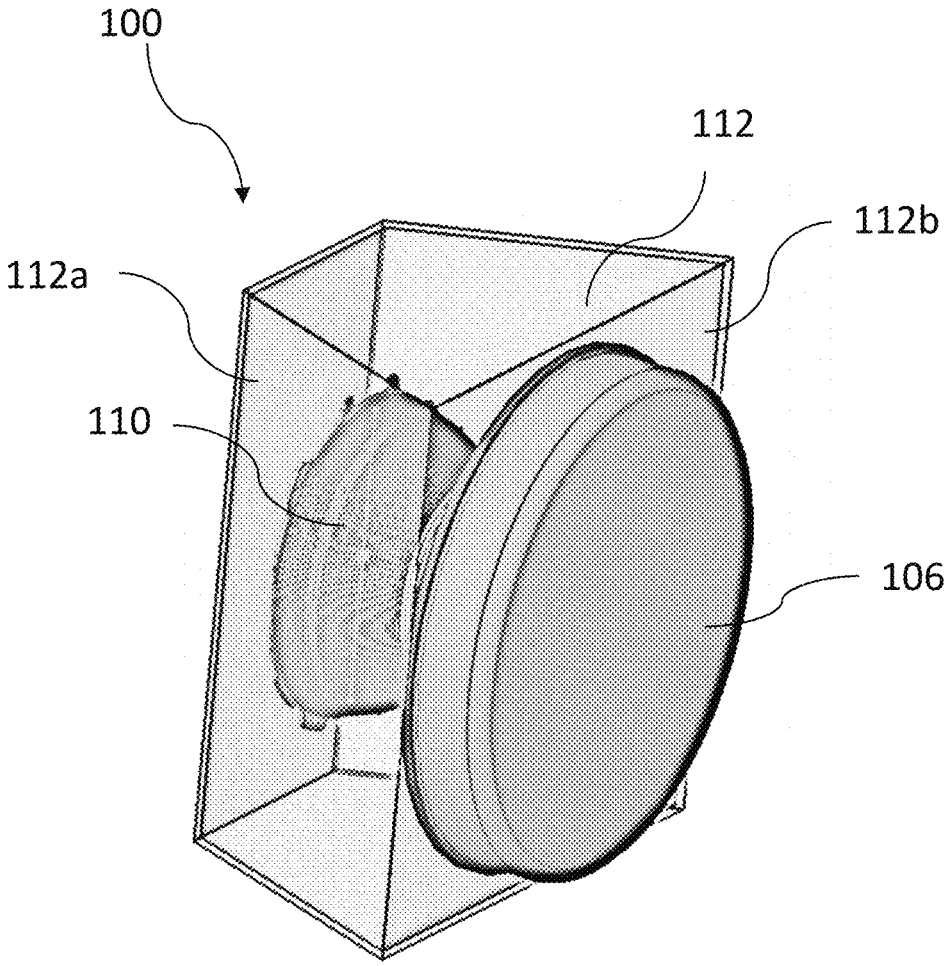
FIG. 2 is a schematic illustrating an LED traffic signal including a replaceable light source that can be implemented within one or more embodiments of the present invention.

FIG. 2 is a schematic illustrating an LED traffic signal 100 including an LED signal replaceable light source 110 (e.g., an LED array) that can be implemented within one or more embodiments of the present invention. As shown in FIG. 2, the LED traffic signal 100 includes a housing 112 including a lower closed end 112*a* and an upper open end 112*b* connected with and closed by the outer refractive optical element 106. The housing 112 is formed of a different material from that of the outer refractive optical element 106. The housing can be formed of a plastic or other suitable material.

According to embodiments of the present invention, the outer refractive optical element 106 is a transparent or clear plastic material. The outer refractive optical element 106 can include an inner facetted surface and an outer smooth surface similar to that disclosed within U.S. Pat. No. 8,668,351 entitled "LED Traffic Signal and Optical Element therefor" by Eden Dubuc, hereby incorporated herein in its entirety.

Figure 3:
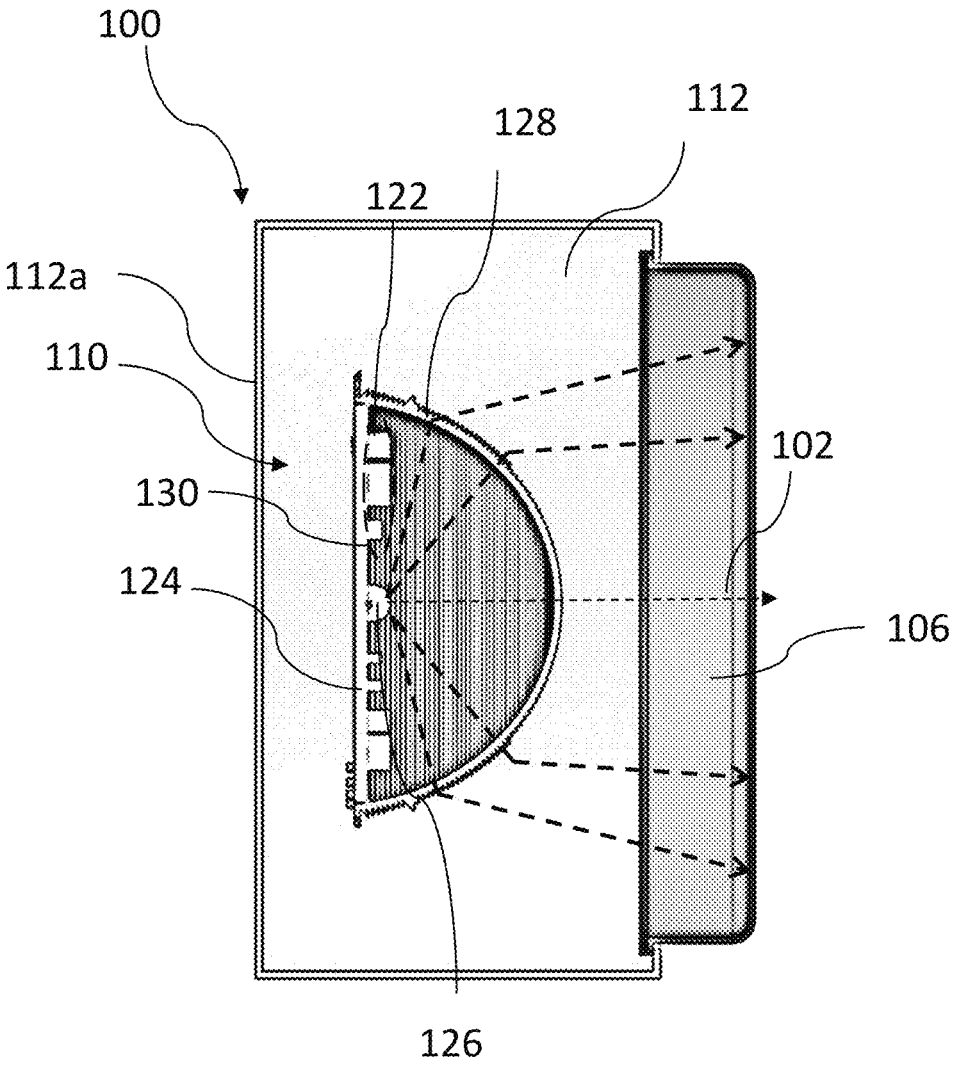
FIG. 3 is detailed schematic illustrating the replaceable light source of FIG. 2 that can be implemented within one or more embodiments of the present invention.

Additional details regarding the LED signal replaceable light source 110 will be discussed below with reference to FIG. 3. As shown in FIG. 3, the LED signal replaceable light source 110 includes an electronic driver (e.g., a LED driver) 122, a light source 126 (e.g., an LED array) and other electronic components on a printed circuit board 124. The printed circuit board 124 is disposed at the base of the LED signal replaceable light source 110 and the light source 126 is centrally disposed on the printed circuit board 124.

The LED signal replaceable light source 110 further includes an inner refractive optical element (lens) 128 connected to the printed circuit board 124 and encapsulating the electronic driver 122. The inner refractive optical element 128 can include an inner smooth surface and an outer facetted surface similar to that disclosed in U.S. Pat. No. 8,666,351 mentioned above. Light generated by the light source 126 is reflected by the inner refractive optical element 128 and exits through the outer refractive optical element 106.

The optical axis 102 is an imaginary line between the center region of the LED array 126 to the center region of the outer refractive optical element 106.

The inner refractive optical element 128 is symmetrical with respect to the optical axis 102. According to alternative embodiments, the inner refractive optical element 114 can be asymmetrical with respect to the optical axis 102.

Further shown in FIG. 3, the light source 126 is disposed on the printed circuit board 124 and situated between the inner refractive optical element 128 and the lower closed end 112*a* of the housing 112. The LED signal replaceable light source 110 can be suspended within the housing 112 by attaching means or seated in another component situated within housing 112. Alternatively, the LED signal replaceable light source 110 can be attached to the lower closed end 112*a* of the housing such that the printed circuit board 124 is secured to the lower closed end 112*a* of the housing 112 by connection portions (not shown).

According to another embodiment, the electronic driver 122 and other components can be disposed on a side of the printed circuit board 124 opposite that of the light source 126 and connected via wires. The components can include a power supply, and other necessary electric components. The electronic driver 122 and other components generate heat, therefore it is desirable to dissipate the heat away from the light source 126 to avoid malfunction and unwanted damage to the LED traffic signal 100. Therefore, according to an embodiment of the present invention, electronic driver 122 and other components can be enclosed within a sealant 130 or resin (e.g., silicon) which is capable of dissipating heat. According to an embodiment, the light source 126, printed circuit board 124, the electronic driver 122 enclosed within a sealant 130 are manufactured together as a single unit.

Therefore, according to an embodiment, to remove the LED signal replaceable light source is disconnected from the housing 112 via any connection means, and removed without requiring replacement of the outer refractive optical element 106 shown in FIG. 2. Instead, the LED signal replaceable light source 110 can be removed from the opening at the upper open end 112*b* of the housing 112 and the outer refractive optical element 106 can be reconnected with the housing 112 after the LED signal replaceable light source is repaired or replaced.

Figure 4:
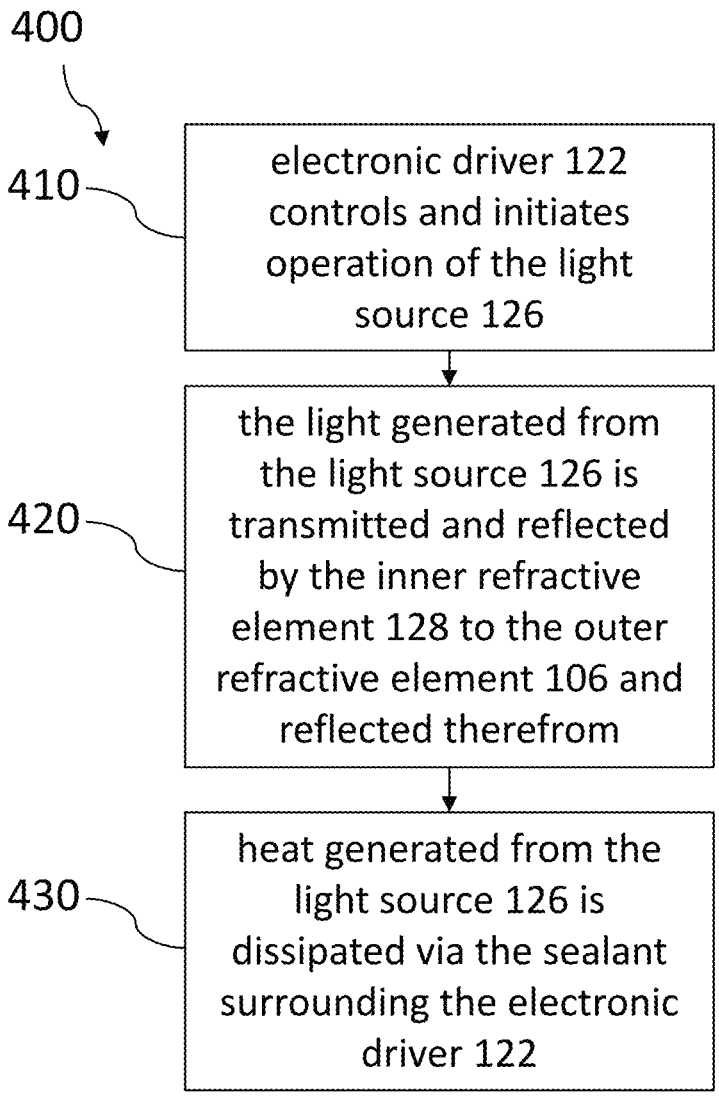
FIG. 4 is a flow diagram illustrating a method of replacing the replaceable light source that can be implemented within one or more embodiments of the present invention.

FIG. 4 is a flow diagram illustrating a method 400 with reference to FIGS. 2 and 3. As shown in FIG. 4, at operation 410, electronic driver 122 controls and initiates operation of the light source 104. From operation 410, the process continues to operation 420 where the light generated from the light source 126 is transmitted and reflected by the inner refractive optical element 128 to the outer refractive optical element 106 and reflected therefrom. From operation 420, the process continues to operation 430, where heat generated from the light source 126 is dissipated via a sealant 130 surrounding the electronic driver 122.

According to another embodiment, the method 400 further replacing the light source 126 by disconnecting the printed circuit board 124 from the housing 112 via any connecting portions if necessary and replacing the entire unit including the light source 126, the electronic driver 122 and other components, the printed circuit board 124, and the inner refractive optical element 128 (as a single unit).

Embodiments of the present invention provide a replaceable light source for an LED traffic signal application that can be easily replaced and/or repaired without replace an outer lens of the LED traffic signal.

This written description uses examples to disclose the invention including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A lighting device comprising:

a housing having an open end and a closed end;

a signal replaceable light source comprising:

a light source connected disposed near the closed end and configured to generate light, the source disposed on a printed circuit board, an inner refractive optical element directly connected to the printed circuit board and encapsulating the light source, such that the light source is situated between the printed circuit board and the inner refractive optical element, the inner refractive optical element configured to reflect the light towards the open end, and an electronic component configured to control operation of the light source; and an outer refractive optical element disposed at the open end and configured to receive the light from the inner refractive optical element and reflect the light therefrom.

2. The lighting device of claim 1, wherein the lighting device is a LED traffic signal.

3. The lighting device of claim 2, wherein the outer refractive optical element is connected with and closes the open end of the housing.

4. The lighting device of claim 3, wherein the lighting device further comprises the light source and the electronic component disposed on a side of the printed circuit board, and connected via wires.

5. The lighting device of claim 4, wherein the printed circuit board is connected with the closed end of the housing via connecting portions.

6. The lighting device of claim 5, wherein the light source, the printed circuit board, and the electronic component form a single unit, to be removable.

7. The lighting device of claim 6, wherein the single unit is removable from the lighting device without replacing the outer refractive optical element.

8. The lighting device of claim 2, wherein electronic component comprises an electronic driver and the light source, the printed circuit board, the electronic component and the inner refractive optical element form a single unit, to be removable.

9. The lighting device of claim 8, wherein the electronic driver is enclosed within a sealant.

10. The lighting device of claim 9, wherein the sealant is a silicon.

11. A lighting device comprising:

a housing having an open end and a closed end;

a lighting component as a single unit, comprising:

a light source disposed along an optical axis and connected to the closed end and configured to generate light, the light source disposed on a printed circuit board, an electronic component configured to control operation of the light source, and an inner refractive optical element directly connected to the printed circuit board and encapsulating the light source, such that the light source is situated between the printed circuit board and the inner refractive optical element, the inner refractive optical element configured to reflect the light; and an outer refractive optical element configured to receive the light from the inner refractive optical element and reflect the light therefrom.

12. The lighting device of claim 11, wherein the inner refractive optical element is symmetrical with respect to the optical axis.

13. The lighting device of claim 12, wherein the lighting component is removable from the housing without replacing the outer refractive optical element.

14. The lighting device of claim 11, wherein the outer refractive optical element is connected with and closes the open end of the housing.

15. The lighting device of claim 11, wherein the lighting component further comprises the printed circuit board positioned on a support, and including the light source and the electronic component disposed thereon, and connected via wires.

16. The lighting device of claim 11, wherein the electronic component comprises an electronic driver and the electronic driver is enclosed within a sealant.

17. A lighting device comprising:

a housing having an open end and a closed end;

a replaceable lighting component within the housing comprising:

a printed circuit board, a light source disposed on the printed circuit board, an electronic component on the printed circuit board configured to control operation of the light source with a resin sealant substantially surrounding the electronic component, and an inner refractive optical element configured to direct light from the light source towards the open end, wherein the light source is situated between the closed end of the housing and the inner refractive optical element, and wherein the printed circuit board, the light source, the electronic component, and the inner refractive optical element form a single removeable unit; and an outer refractive optical element disposed at the open end and configured to receive the light from the inner refractive optical element.

18. The lighting device of claim 17, wherein the lighting device is a LED traffic signal.

19. The lighting device of claim 17, wherein the outer refractive optical element is connected with and closes the open end of the housing.

20. The lighting device of claim 17, wherein the inner refractive optical element is directly connected with the printed circuit board.

* * * * *